US006474613B2

(12) United States Patent
O'Malley

(10) Patent No.: US 6,474,613 B2
(45) **Date of Patent: *Nov. 5, 2002**

(54) HIGH STORAGE DENSITY ROLL STOCK STACKING SUPPORT

(76) Inventor: Joseph O'Malley, 251 W. Taylor Rd., Selah, WA (US) 98942

( * ) Notice: Subject to any disclaimer, the term of this patent is extended or adjusted under 35 U.S.C. 154(b) by 0 days.

This patent is subject to a terminal disclaimer.

(21) Appl. No.: 09/997,060

(22) Filed: Nov. 27, 2001

(65) Prior Publication Data

US 2002/0063194 A1 May 30, 2002

Related U.S. Application Data

(63) Continuation-in-part of application No. 09/613,652, filed on Jul. 11, 2000, now Pat. No. 6,322,034, which is a continuation-in-part of application No. 09/330,536, filed on Jun. 11, 1999, now Pat. No. 6,209,839.

(51) Int. Cl.[7] ..... B65D 19/00
(52) U.S. Cl. ..... 248/346.02; 248/68.1
(58) Field of Search ..... 248/346.01, 68.1, 248/346.02; 211/594; 206/395, 597, 419

(56) References Cited

U.S. PATENT DOCUMENTS

| | | | | |
|---|---|---|---|---|
| 2,766,660 | A | 10/1956 | Laddon et al. | 89/1.5 |
| 3,837,560 | A | 9/1974 | Kuchuris et al. | 229/15 |
| 4,195,732 | A | 4/1980 | Bell | 206/391 |
| 4,240,557 | A | 12/1980 | Dickens | 211/153 |
| 4,378,923 | A | 4/1983 | Takei | 248/68 R |
| 4,435,463 | A | 3/1984 | Roellchen | 428/158 |
| 4,610,362 | A | 9/1986 | Remp et al. | 211/59.4 |
| 4,705,170 | A | 11/1987 | Creaden | 206/419 |
| 4,792,045 | A | 12/1988 | Creaden | 206/419 |
| 4,832,196 | A | 5/1989 | Butler | 206/391 |
| 4,901,870 | A | 2/1990 | Wright et al. | 211/59.4 |
| 4,936,453 | A | 6/1990 | Knitter | 206/419 |
| 5,080,314 | A | 1/1992 | Moyer et al. | 248/346 |
| 5,100,076 | A | 3/1992 | Cobane et al. | 242/71.8 |
| 5,123,547 | A | 6/1992 | Koch | 211/59.4 |
| 5,161,703 | A | 11/1992 | Patton | 211/294 |
| D345,845 | S | 4/1994 | Strzegowski, Jr. | D34/38 |
| 5,381,898 | A | 1/1995 | Jones | 206/391 |
| 5,415,286 | A | 5/1995 | Marchek et al. | 206/330 |
| 5,421,537 | A | 6/1995 | Cobane et al. | 242/614 |
| 5,433,322 | A | 7/1995 | Williams | 206/443 |
| 5,499,716 | A | 3/1996 | Gardner | 206/553 |
| D381,180 | S | 7/1997 | Schueneman et al. | D34/38 |
| 5,649,632 | A | 7/1997 | Terashima et al. | 211/59.4 |
| D384,481 | S | 9/1997 | Sheckells | D34/38 |
| D385,080 | S | 10/1997 | Schueneman et al. | D34/38 |
| 5,755,541 | A | 5/1998 | Suarez | 410/36 |
| D400,441 | S | 11/1998 | Warren | D9/456 |
| 5,829,592 | A | 11/1998 | Henry, Jr. et al. | 206/416 |
| D403,961 | S | 1/1999 | Warren | D9/456 |
| 5,873,460 | A | 2/1999 | Reinhardt | 206/321 |
| D408,737 | S | 4/1999 | Warren, Jr. | D9/456 |
| 5,899,331 | A | 5/1999 | Warren, Jr. | 206/443 |
| 5,934,467 | A | 8/1999 | Gilfert et al. | 206/391 |
| 5,960,954 | A | 10/1999 | Seybold | 206/389 |
| 6,142,440 | A * | 11/2000 | Gratz et al. | 248/346.01 |

* cited by examiner

*Primary Examiner*—Ramon O. Ramirez
(74) *Attorney, Agent, or Firm*—R. Reams Goodloe, Jr.

(57) ABSTRACT

A support for receiving and supporting stacked tiers of cylindrical roll stock is provided. The support can be either located below a first tier of the roll stock, placed between tiers of roll stock, or secured above the top tier, all to provide a stacked arrangement of the roll stock that is especially suited for storage or transport. The roll support is preferably formed from a resinous plastic, polymeric material, such as PET that includes a plurality of curved cradles and each curved cradle is sized for receiving a roll of cylindrical stock. A multiple of the support bodies combine to support a multiple of the rolls of cylindrical stock in a tiered array. Each support body can substantially support the weight of each roll of cylindrical stock received within its curved cradles. The roll supports are manufactured in thin, nestable configurations, and can be stored with a minimum of nested stack height.

30 Claims, 9 Drawing Sheets

60A
38
40
60B
62A
64A
T
64B
66B2
20A
34
36
38
42
40
50
20B
72
74
76
80
82
78
62B

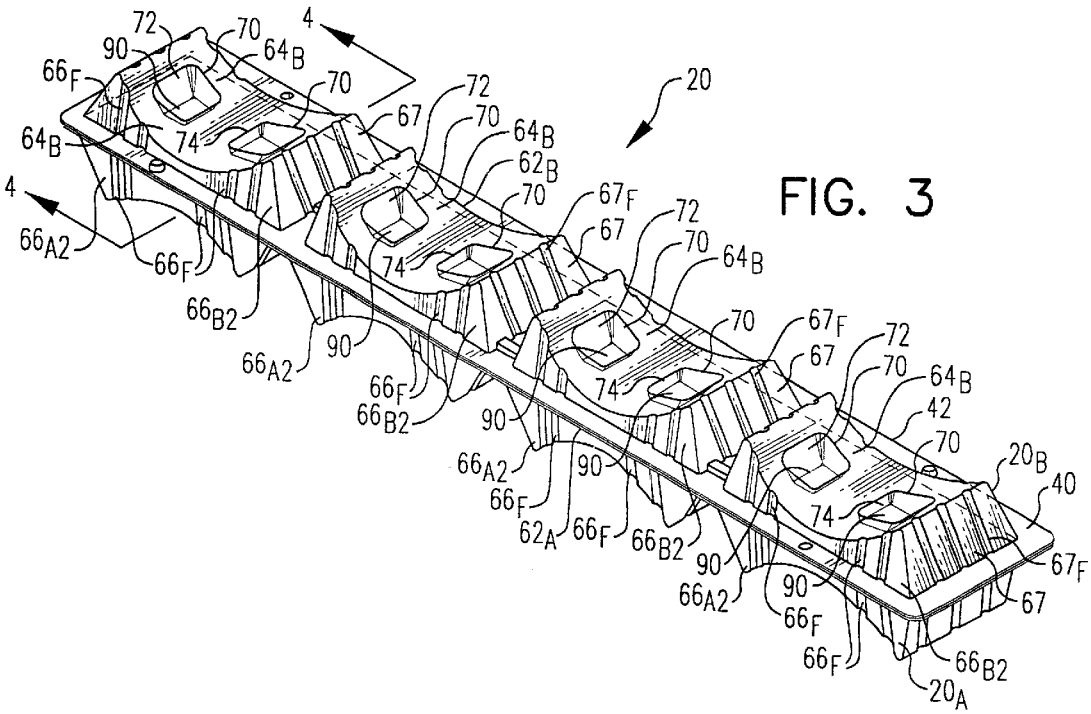
FIG. 3
FIG. 4
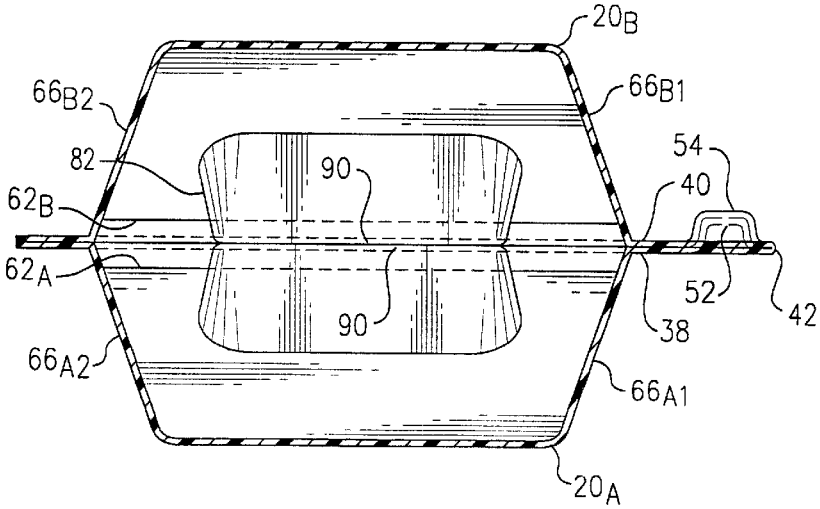

HIGH STORAGE DENSITY ROLL STOCK STACKING SUPPORT

PRIORITY, RELATED APPLICATIONS

This application is a Continuation-In-Part of prior application Ser. No. 09/613,652, filed Jul. 11, 2000, now U.S. Pat. No. 6,322,034, issued Nov. 27, 2001, which was a Continuation-In-Part of prior application Ser. No. 09/330,536, filed Jun. 11, 1999, now US Pat. No. 6,209,839, issued Apr. 3, 2001, the disclosures of which are incorporated herein in their entirety by this reference.

TECHNICAL FIELD

The invention relates to stacking supports for roll stock, and more particularly to nestable stacking supports for roll stock.

BACKGROUND

"Roll stock," is a term that is commonly used to describe cylindrical rolls or tubular rolls of a selected width of thin materials. Such items include paper products, plastic film products, thin gauge metals, roofing sheets, and various other thin materials. Many cylindrical or tubular shaped rolls are packed on pallets for shipping and storage. Such packing is often provided in tiers of rolls, and commonly, the rolls are horizontally oriented above the pallets. Consequently, in order to stabilize and support the cylindrical or tubular rolls, stacking supports have typically been employed.

Various materials and structures have been suggested, attempted, or actually used for receiving stacked rolls of materials. Some disclosures have suggested the use of a support and spacing member for roll stock formed from expanded polystyrene foam. However, certain characteristics of polystyrene foam make it less than ideal for use in roll stock supports. This is because expanded polystyrene is rather rigid, relatively brittle, and thus has a minimum of structural flexibility. Additionally, polystyrene foam rolls supports do not typically compactly nest together and thus storage of roll supports manufactured of polystyrene or similar plastic materials usually takes up considerable space.

One alternative to polystyrene foam roll supports has been the development and use of roll supports made from papier-mâché. Unfortunately, in many circumstances, papier-mâché is inadequate for roll stock supports. For example, the strength of papier-mâché roll stock supports rapidly degrades which they get wet. Consequently, papier-mâché roll sock supports must be protected from the weather, and even cannot be used in many humid environments. Such weather protection is especially difficult during transport, and requires that such supports be shipped within a fully enclosed container or trailer. Further, even though roll supports manufactured from papier-mâché have improved stackability over foam type roll supports, the papier-mâché roll stackers must be of substantial thickness to support the weight of many materials.

Therefore, it can be appreciated that there still remains a need for an improved roll stacker design which can be manufactured utilizing a material that would reduce the storage space requirements of roll supports, so as to free up warehouse space. And, there remains a need for a strong, weather-proof, preferably recyclable material which can be utilized in the production of compactly stackable roll supports.

BRIEF DESCRIPTION OF THE DRAWING

In order to enable the reader to attain a more complete appreciation of the invention, and of the novel features and the advantages thereof, attention is directed to the following detailed ion when considered in connection with the accompanying drawings, wherein:

FIG. 3 is a perspective view of one embodiment of a pair of roll supports provided in a back-to-back configuration, for use in stacking roll stock in the manner illustrated in FIG. 1 above.

FIG. 4 is a vertical cross sectional view, taken as through line 4—4 of FIG. 3, illustrating the generally stadium shaped supports platforms as well as the alignment locks utilized to regsister one of a pair of roll supports to another.

In the various figures, it should be noted that the use of subscripts, such as in reference to support cradle portions $62_A$ or $62_B$, still generally refers to the structure so named without the subscript (such as roll support structure 62), but such subscripts are merely used for convenience with addressing similar structures either side-by-side or back-to-back pairs of roll supports, to distinguish similar structures in roll supports formed and/or used together.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, various other elements of the roll supports are also shown and briefly described to enable the reader to understand how various features, including optional or alternate features, may be utilized in order to provide a compact, efficiently nestable, reliable material structure for a roll stacking support.

DETAILED DESCRIPTION

Figure 1:
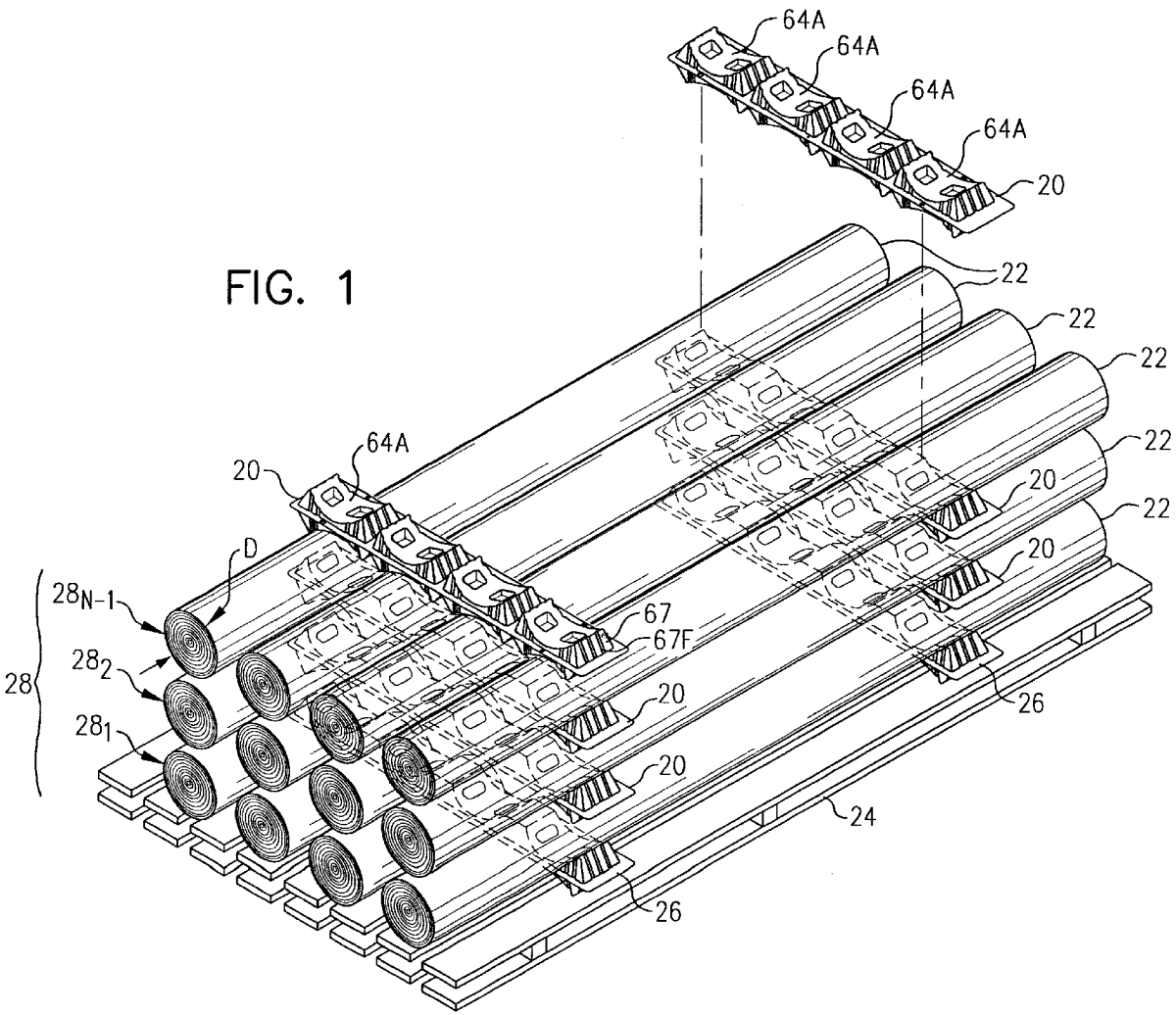
FIG. 1 is a perspective view of a plurality of roll supports, shown in working arrangement to support stacked layers of roll stock on a shipping pallet.

Attention is now directed to FIG. 1, wherein one embodiment of an improved, novel roll support is illustrated. Here, a pair 20 of roll supports are oriented in back-to-back configuration as used to provide spacing and support to a number of pieces of roll stock 22 situated on a pallet 24. As illustrated in FIG. 1, the roll support pair 20 is provided as a pair of single roll supports 26 oriented in a back-to-back configuration. However, a single roll support 26 can be utilized as necessary below a first or lowest layer 28, of N layers 28 of roll stock 22 above pallet 24. Then, a back-to-back pair of roll supports 20 can be used between lower layer $28_1$, and the next layer $28_2$, repeating between layers up to the Nth or upper layer $28_N$ in a series of layers $28_1$ through $28_N$. Note however, that in this FIG. 1, only the next to last layer, layer $28_{N-1}$ of roll stock 22 is illustrated. If desired for packing and strapping, the configuration shown at the bottom, next to the pallet 24, utilizing a single roll support 26, could be repeated, reversed in mirror image fashion, above the last layer $28_N$.

Figure 2:
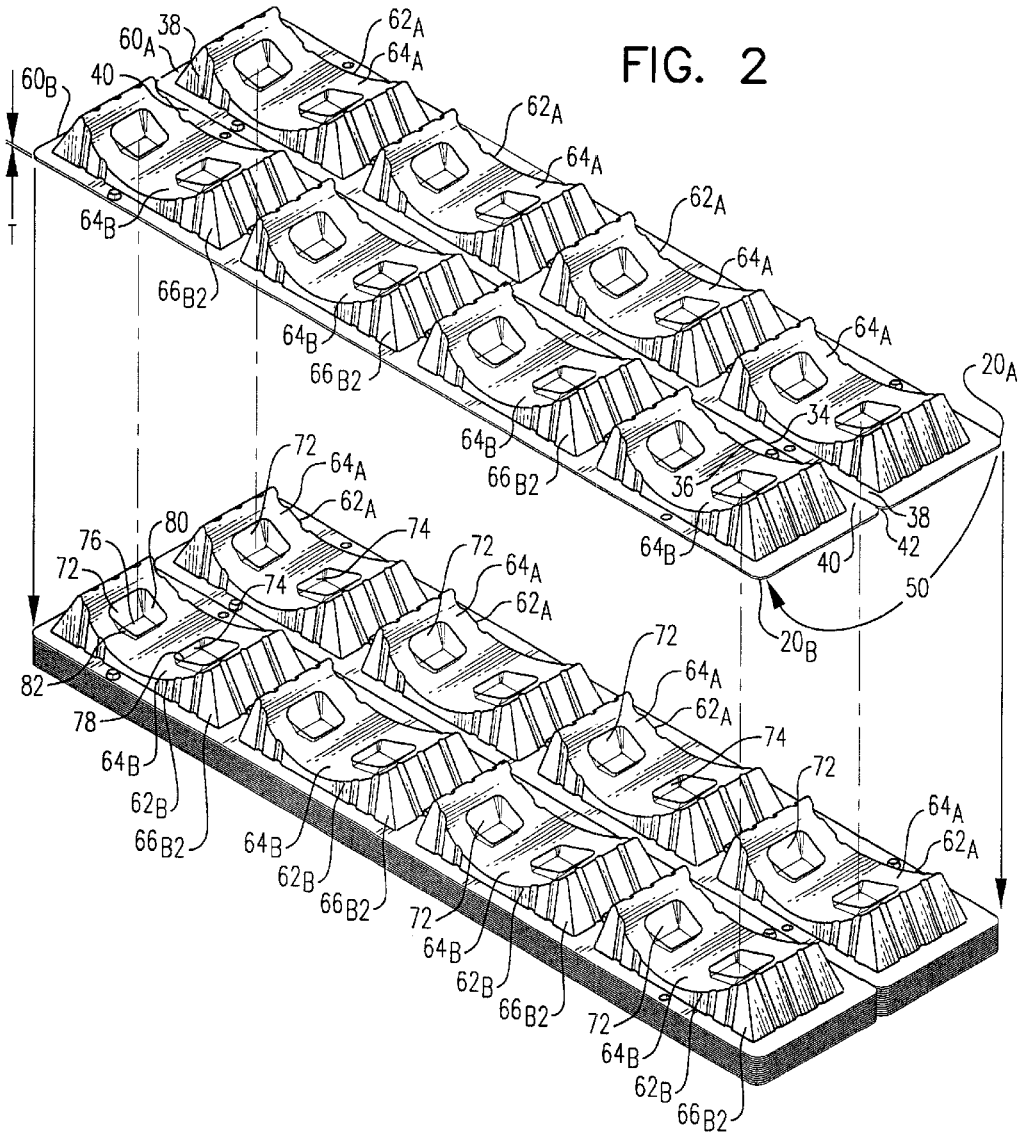
FIG. 2 is a perspective view of a pair of roll supports situated side-by-side, showing pairs of roll supports nested and stacked for shipping and storage.

Roll supports 26 may be manufactured singularly, or as noted in FIG. 2, may be manufactured in pairs $20_A$ and $20_B$ which may be flexibly joined or "hinged" along adjacent edge portions 34 and 36 of the respective base portions 38 and 40 of pairs $20_A$ and $20_B$. If pairs are provided in manufacture, a flexible joint 42 is formed by further thinning the material of construction and allowing only a very thin portion of material to connect the pairs $20_A$ and $20_B$. Alternately, a plurality of longitudinally extending thin transverse strips can be used to connect the adjoining sections $20_A$ and $20_B$ of a roll support pair 20.

In FIG. 2, note that reference arrow 50 shows how a first one $20_A$ of a pair of roll supports is folded under a second one $20_B$ of the pair of roll supports, to transform the pair from a side-by-side configuration to a back-to-back configuration.

As better seen in FIG. 4, regardless of whether the roll supports are provided in singular or half-portions 26, or in pairs 20, when situated in a back-to-back configuration a first alignment lock 52 in first roll support section 26 (or $20_A$) is folded over in close fitting interlocking fashion with a second alignment lock 54 in second roll support section 26 (or $20_B$). In one embodiment, the pair of alignment locks 52 and 54, are configured as mating dimples as shown in this FIG. 4. Note that in this configuration, alignment locks 52 and 54 provide for registration detents that serve to register first and second roll supports 26, (or portions $20_A$ and $20_B$ if manufactured together, even if in this latter case such sections become disconnected along joint 42 during continued use of the roll support pair 20).

As also noted in FIG. 2, the roll support design 26 (or roll support pairs 20 when provided in hinged pairs $20_A$ and $20_B$) allows for compact nesting, which thus allows compact storage. In order to take maximum advantage of this feature, the roll supports can be manufactured from a resinous plastic polymeric material. Resinous plastics which may be utilized for the roll support include high-density polymers that produce a strong, yet flexible final product. A resinous plastic polymer material that can be thermoformed be utilized to provide a desired final shape. On suitable resinous plastic material found to be useful is polyethylene terephthalate material, commonly known by the abbreviation "PET".

Instead of providing a cushioning support, as would be desired when protecting a fragile article such as glass, or light bulbs or the like, supports for much roll stock must be strong and resistant to deformation. Such applications are ideal for PET, since PET resin forms a high strength product with good strength in all directions. Also, many businesses now prefer that materials be manufactured from recycled materials. The disclosed roll supports are easily fabricated from recycled plastic materials. Also, use of recycled plastic material is a great advantage over most prior art cellulose materials, since recycling of cellulose materials suitable for packaging roll supports is considered more complex and difficult than manufacture of plastic materials from recycled materials. In the manufacture of roll supports, suitable recycled plastics are relatively easy to reprocess. PET, as with a great variety of plastic materials, is initially segregated at time of disposal, after which it is typically kept clean and uniform during the entire recycling process. This process substantially enhances the likelihood of retaining desirable material properties in a finished roll support made from recycled materials.

Another important property which is achieved by the use of PET is that paired roll supports 20 can easily stack over a previous pair with only a slight increase in height. As shown in FIG. 2, the thickness T of the roll support can be as little as from approximately 40 Mils to approximately 60 Mils (or from about 0.04 inches to about 0.06 inches). In one embodiment, the thickness T can be limited to not exceed the lower end of this range, or 40 Mils (0.040 inches). Thus, with such manufactured thickness, roll supports 26 could be stacked from approximately 16 per inch, to about 20 per inch, and even up to as dense as about 26 per inch. Of course, it is desirable from a storage and nesting perspective that thicknesses be provided which occur at the lower end of the stated thickness range. This very small thickness, when nested, is a significant advantage over the stacked pairs of prior art papier-mâché material, since papier-mâché material prohibits such a close nested stacking of new or used roll supports. For example, about an eight to one advantage in stacking of PET roll supports is provided over commercially available fabricated in prior art papier-mâché materials. In one test, it was found that a vertical stack of 1280 roll supports 20 could be situated within the same vertical height in which only about 160 prior art papier-mâché roll supports occupied. In another test, it was found that about 960 prior art papier-mâché roll supports will occupy, volumetrically, roughly six times the warehouse volume that which is occupied by 1280 of the roll supports provided herein (when measured comparably, either in pairs or singularly). Moreover, it as been found that about 1280 roll supports 20 occupy, volumetrically, roughly 12 times the warehouse volume of that occupied by one brand of prior art polystyrene foam roll supports. Thus, the nesting compactness of the present invention provides a substantial and significant savings in shipping and storage space, as compared to prior art papier-mâché or other foam or plastic materials. Thus, it is important to note that warehouse space saved in the storage of nested and still unused roll supports can be allotted to other storage needs. Alternatively, the saved storage or shipping space can be used to store or transport additional roll supports and allow the purchase of higher quantities to realize bulk rate cost savings and substantially reduce freight costs.

As earlier described in conjunction with FIGS. 2 and 4 above, each member $\mathbf{20}_A$ and $\mathbf{20}_B$ of a pair of roll supports 20 may be provided joined to the other in a flexible, foldable edge hinge 42 that provides the connected pair $\mathbf{20}_A$ and $\mathbf{20}_B$ with the ability to fold together and form a back-to-back support configuration as shown in FIGS. 1, 3 and 4. Additionally, the flexible hinge 42 can be utilized as a separation edge, for detaching the pair $\mathbf{20}_A$ and $\mathbf{20}_B$ from each other and forming two separate, detached roll supports portions, as noted in conjunction with the discussion of FIG. 1 above.

A pair of roll supports 26 (or portions $\mathbf{20}_A$ and $\mathbf{20}_B$ taken together as a joined roll support pair 20), are suited for receiving and supporting one or more pieces of roll stock of a selected diameter D and radius R. Each of the roll supports 26 have a first elongated upper surface 60, with a plurality of roll support cradle portions 62 thereon. Similarly, each of the roll support portions $\mathbf{20}_A$ and $\mathbf{20}_B$ have a first elongated upper surface $\mathbf{60}_A$ and $\mathbf{60}_B$, respectively, each having a plurality of roll support cradle portions $\mathbf{62}_A$ or $\mathbf{62}_B$ thereon. Each of the roll support cradle portions $\mathbf{62}_A$ and $\mathbf{62}_B$ have an outward surface $\mathbf{64}_A$ or $\mathbf{64}_B$ shaped in an arcuate segment of pre-selected dimensions adapted for securely receiving a piece of roll stock 22 of substantially complementary shape, i.e., preferably complementary diameter D or radius R. To support the roll support cradle portions $\mathbf{62}_A$ and $\mathbf{62}_B$, a pair of longitudinally running opposing sidewall portions $\mathbf{66}_{A1}$, and $\mathbf{66}_{A2}$, and $\mathbf{66}_{B1}$ and $\mathbf{66}_{B2}$ (see FIG. 4) are provided in each of portions $\mathbf{20}_A$ and $\mathbf{20}_B$, respectively. When viewed in the side-by-side configuration (see FIG. 5, for example), each of the opposing sidewall portions ($\mathbf{66}_{A1}$, $\mathbf{66}_{A2}$, $\mathbf{66}_{B1}$, $\mathbf{66}_{B2}$) slope inwardly and upwardly toward the shaped outward surface $\mathbf{64}_A$ or $\mathbf{64}_B$, respectively, or the roll support cradle portions $\mathbf{62}_A$ or $\mathbf{62}_B$.

Roll support 26, or portions $\mathbf{20}_A$ and $\mathbf{20}_B$, have a base, 38 and 40, respectively in the latter case, each of which provides structural support to the adjacent opposing sidewall portions ($\mathbf{66}_{A1}$, $\mathbf{66}_{A2}$, $\mathbf{66}_{B1}$, $\mathbf{66}_{B2}$, as applicable) These opposing sidewall portions, in turn, each provide structural support to the applicable roll support cradle portions $\mathbf{64}_A$ or $\mathbf{64}_B$. Within the opposing sidewall portions $\mathbf{66}_{A1}$, $\mathbf{66}_{A2}$, $\mathbf{66}_{B1}$, and $\mathbf{66}_{B2}$, strengthening flutes $\mathbf{66}_F$ are provided. These flutes $\mathbf{66}_F$ may be provided in the shape of arc portions of a length of cylinder, where the cylinder has a preselected diameter. One suitable diameter ranges from about 0.25 inches to about 0.50 inches. Preferably at least one strengthening flute 66F is provided along a selected opposing sidewall $\mathbf{66}_{A1}$, $\mathbf{66}_{A2}$, $\mathbf{66}_{B1}$, or $\mathbf{66}_{B2}$, on either side (longitudinally) of the bottom 96 of the roll cradle support portion $\mathbf{64}_A$ or $\mathbf{64}_B$. More preferably, two strengthening flutes $\mathbf{66}_F$ are provided on either side (longitudinally) of the bottom 96 of the roll cradle support portion $\mathbf{64}_A$ or $\mathbf{64}_B$ along the respective opposing sidewall $\mathbf{66}_{A1}$, $\mathbf{66}_{A2}$, $\mathbf{66}_{B1}$, or $\mathbf{66}_{B2}$.

Figure 15:
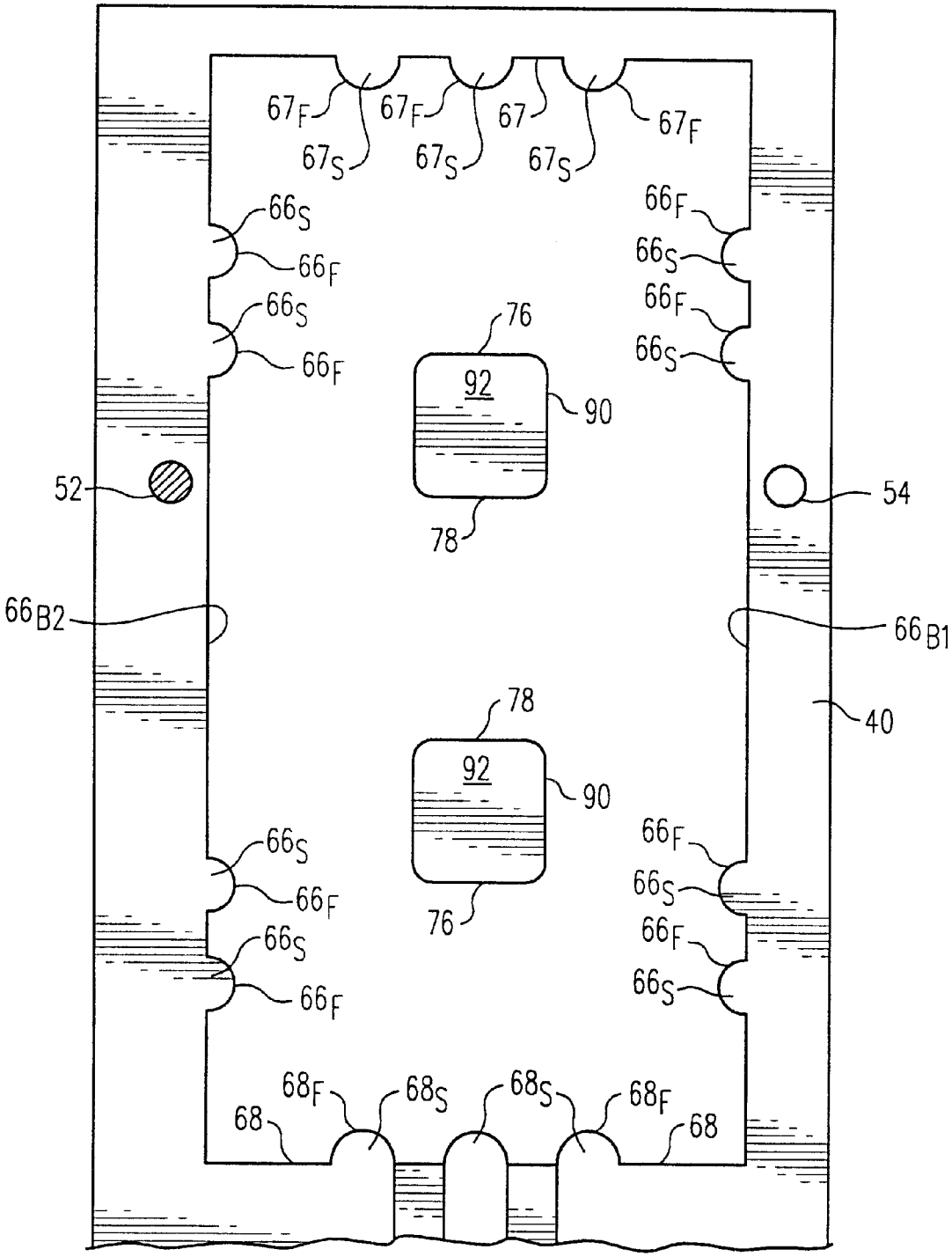
FIG. 15 is a "footprint" view of a portion of a single unit of a support apparatus of the type set forth in FIGS. 2 and 4 above, now showing the footprint of such a single unit, as when it contacts a support pallet, or when used against another support unit in back-to-back fashion, showing in particular the "footprint" of the various reinforcing flutes, as well as the footprint of the bottom support foot of a "stadium shaped" support platform.

At opposing ends of the roll support cradle portions $\mathbf{64}_A$ or $\mathbf{64}_B$, a first end wall portion 67 and a second end wall portion 68 are provided. These first and second end walls slant inwardly and downwardly toward the respective intervening base portion between roll support cradle portions $\mathbf{64}_A$ or $\mathbf{64}_B$. As illustrated, this angle is provided equal to an incline of about twenty degrees (20°) from the vertical (or alternately stated, is at a seventy degree (70° incline). Within the first and second end wall portions 67 and 68, strengthening flutes $\mathbf{67}_F$ and $\mathbf{68}_F$, respectively, are provided, preferably oriented along the plane of the respective first or second end wall portion. As illustrated (but not necessarily limited thereto) the flutes $\mathbf{67}_F$ and $\mathbf{68}_F$ each are provided in a long, rounded groove in their respective first end wall portion or second end wall portion. These flutes $\mathbf{67}_F$ and $\mathbf{68}_F$ may be provided in the shape of arc portions of a length of cylinder, where the cylinder has a preselected diameter. One suitable diameter ranges from about 0.25 inches to about 0.50 inches. At least one flute $\mathbf{67}_F$ is provided in end wall portion 67, and more preferably, at least three flutes $\mathbf{67}_F$ are provided. Likewise, at least one flute $\mathbf{68}_F$ is provided in second end wall portion 68, and more preferably, at least three flutes $\mathbf{68}_F$ are provided in second end wall portion 68. Also note by reference to FIG. 15 that a foundation support $\mathbf{66}_S$, $\mathbf{67}_S$, or $\mathbf{68}_S$, is provided at each flute $\mathbf{66}_F$, $\mathbf{67}_F$, or $\mathbf{68}_F$, respectively.

Figures 5, 6, 7, 8:
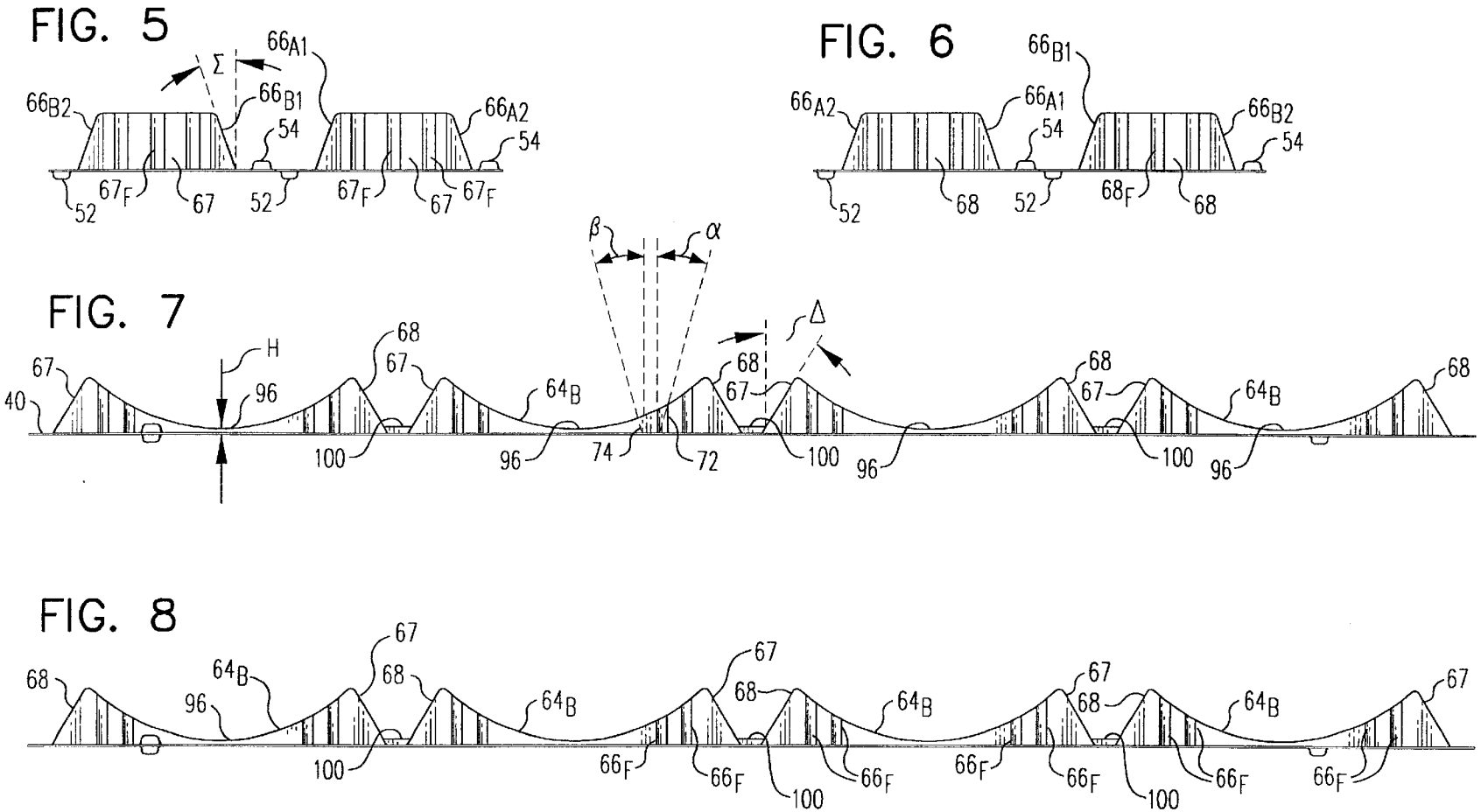
FIG. 5 is a first end view of a pair of roll supports, showing the first end view of a pair of roll supports as shown in FIG. 2 above.
FIG. 6 is a second end view of a pair of roll supports, showing the second end view of the pair of roll supports shown in FIGS. 2 and 5 above.
FIG. 7 is side elevation view, taken along one of the opposing sidewalls of a first of a roll support.
FIG. 8 is a side elevation view, taken along the opposite side of a roll support as the view first provided in FIG. 7.
Figure 9:
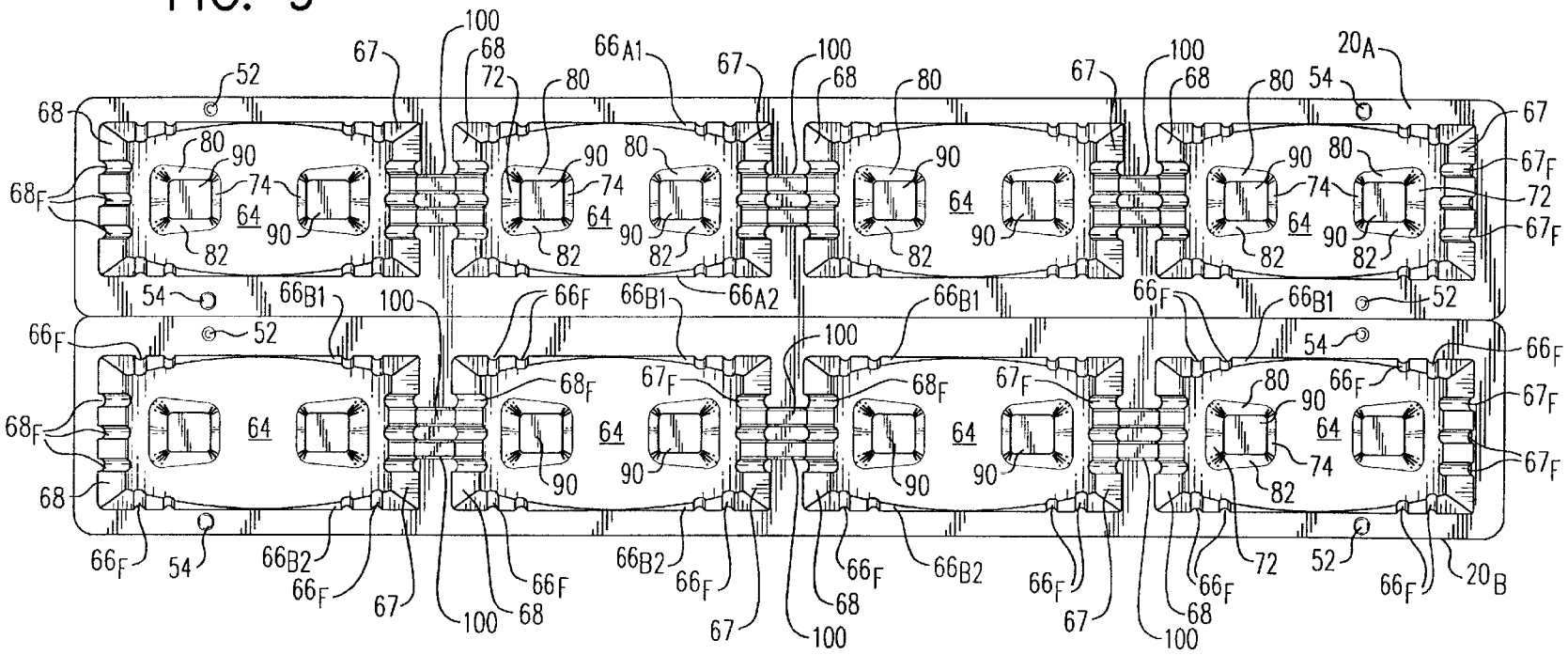
FIG. 9 is a top plan view, taken looking downward on a pair of roll supports situated side by side.
Figure 10:
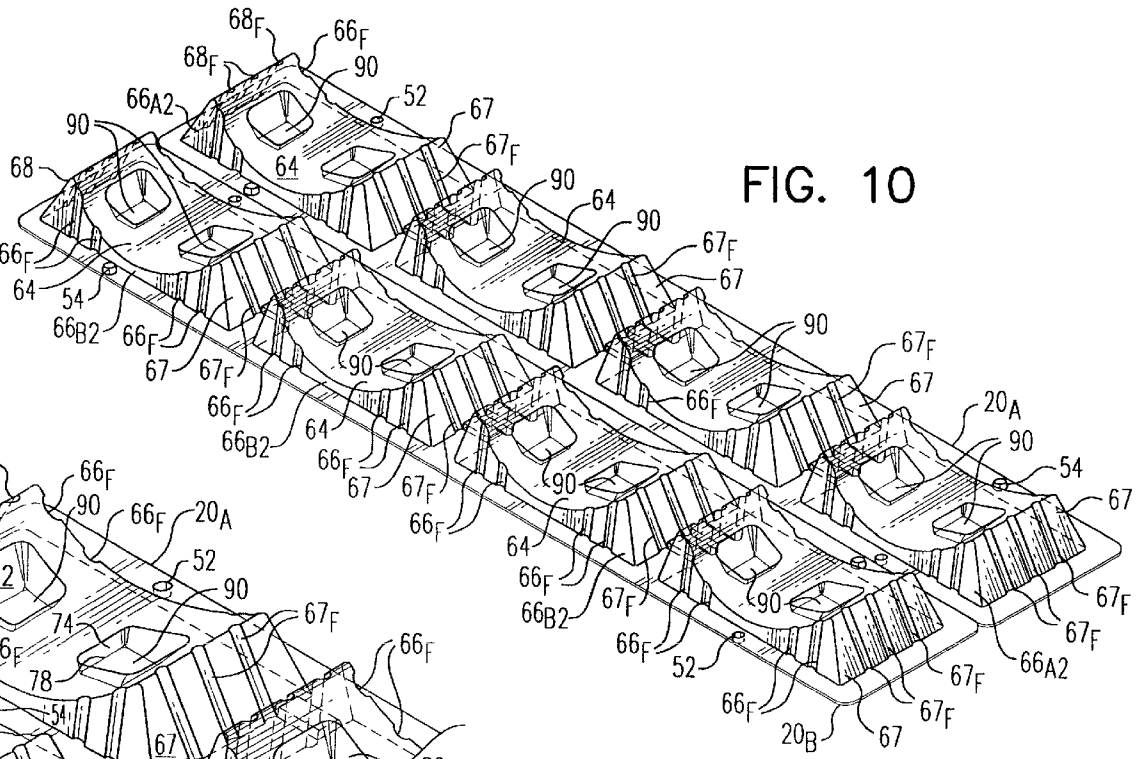
FIG. 10 is a perspective view of the embodiment of a pair of roll supports as just shown in FIG. 9, showing the roll supports with structurally enhancing flutes in opposing sidewall portions, and structurally enhancing flutes in the sloping sidewalls of the first and second end portions located at opposing ends of a roll support portion.

To enhance structural strength, one or more support platforms 70 is provided in each of the roll support cradle portions $\mathbf{64}_A$ or $\mathbf{64}_B$. Each of the support platforms 70 has first 72 (or long) and second 74 (or short) inwardly and downwardly sloping sidewall portions, each having a lower end portion 76 and 78, respectively. Also, the support platforms have opposing wall portions 80 and 82. A bottom support foot 90 is located adjacent the lower end portions 76 and 78 of the first 72 and second 74 inwardly and downwardly sloping sidewall portions. As indicated in FIG. 7, the inwardly sloping sidewall 72 is at an angle alpha ($\alpha$) of about 20 degrees from the vertical (or, alternately stated, is at a seventy degree incline). Also as indicated in FIG. 7, the inwardly sloping wall 74 is at an angle beta ($\beta$) of about 20 degrees from the vertical (or, alternately stated, is at a seventy degree incline).

The bottom support foot 90 extends laterally across a portion of the respective roll support cradle portion $\mathbf{64}_A$ or $\mathbf{64}_B$. Also, the bottom support foot 90 extends downwardly, when the roll supports are viewed in a side-by-side configuration, to a location substantially even with the height or plane of the respective base 38 or 40. This is confirmed by the footprint illustrated in FIG. 15, as well as shown in FIG. 4. When a back-to-back configuration is utilized, the bottom side 92 of support foot 90 of first roll support portion $\mathbf{20}_A$ and the bottom side 92 of a second support foot 90 in the second roll support portion $\mathbf{20}_B$ are in opposing contact for strong structural support. As depicted in the various figures, one advantageous shape for the support platforms 70 is a "stadium bowl", broadly concave shaped configuration having a flat bottom and sloped sidewalls.

As can be seen in various figures, and evident in the side view shown in FIG. 7, each of the roll support cradle portions $\mathbf{64}_A$ or $\mathbf{64}_B$ has a bottom portion 96 (at the bottom of the curve), wherein the bottom portion 96 is elevated above the respective base. As illustrated, the bottom portion 96 of the roll support cradle portion is elevated a height H about 0.25 inches above the base 38 or 40.

Also, I the embodiment illustrated in FIGS. 5 and 6, opposing sidewall portions $\mathbf{66}_{A1}$, $\mathbf{66}_{A2}$, $\mathbf{66}_{B1}$, and $\mathbf{66}_{B2}$ can be provided angled upward and inward at an angle sigma ($\Sigma$) of about twenty degrees (20°), i.e., to allow a seventy degree (70°) slope on the selected opposing sidewall, when viewed from above.

Figure 13:
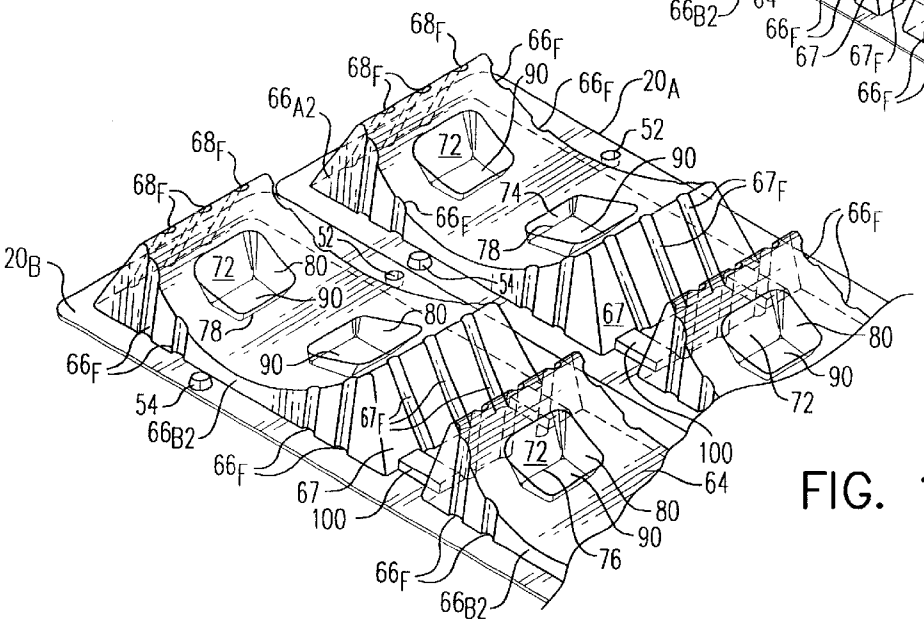
FIG. 13 is a partial perspective view of the second embodiment of a roll support as just illustrated in FIG. 12 above, now showing strengthening bars between first and second end wall portions, where the strengthening bars are spread apart transversely beyond the structurally enhancing flutes in each of the first and second end wall portions.
Figure 11:
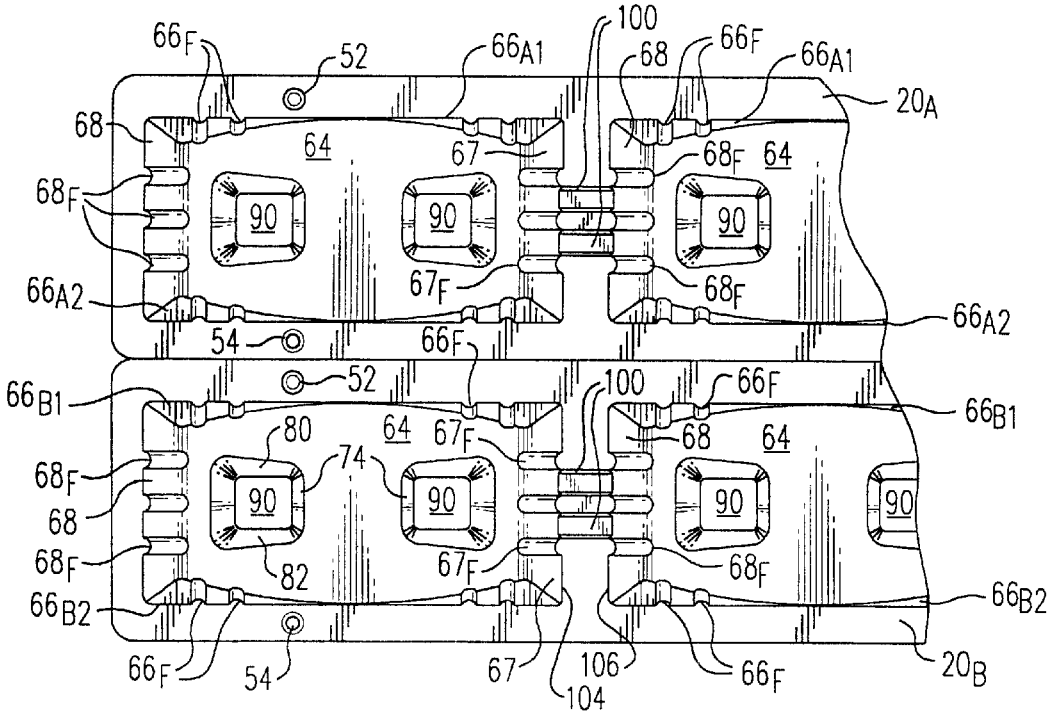
FIG. 11 is a partial top plan view of the embodiment of a pair of roll supports as just illustrated in FIGS. 9 and 10 above, now showing in detail the raised strengthening bars between adjacent first and second end wall portions between roll support portions.
Figure 14:
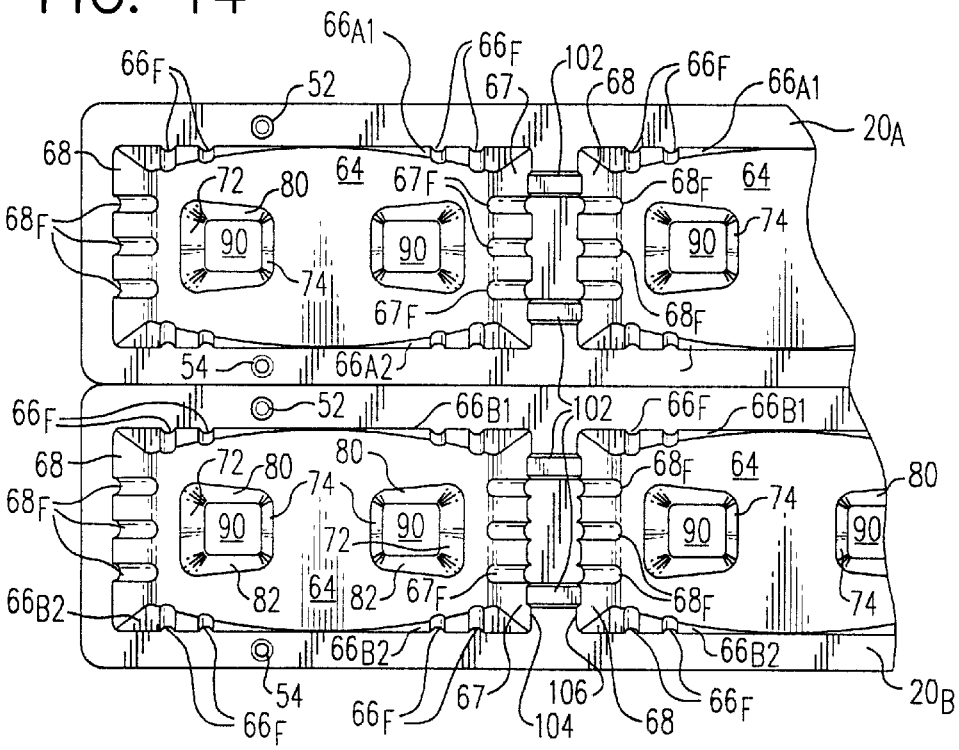
FIG. 14 is a partial top plan view of the embodiment of a pair of roll supports as just illustrated in FIGS. 12 and 13 above, now showing in detail the raised strengthening bars between adjacent first and second end wall portions, with the strengthening bars located outside of the structurally enhancing flutes in each of the first and second end wall portions.
Figure 12:
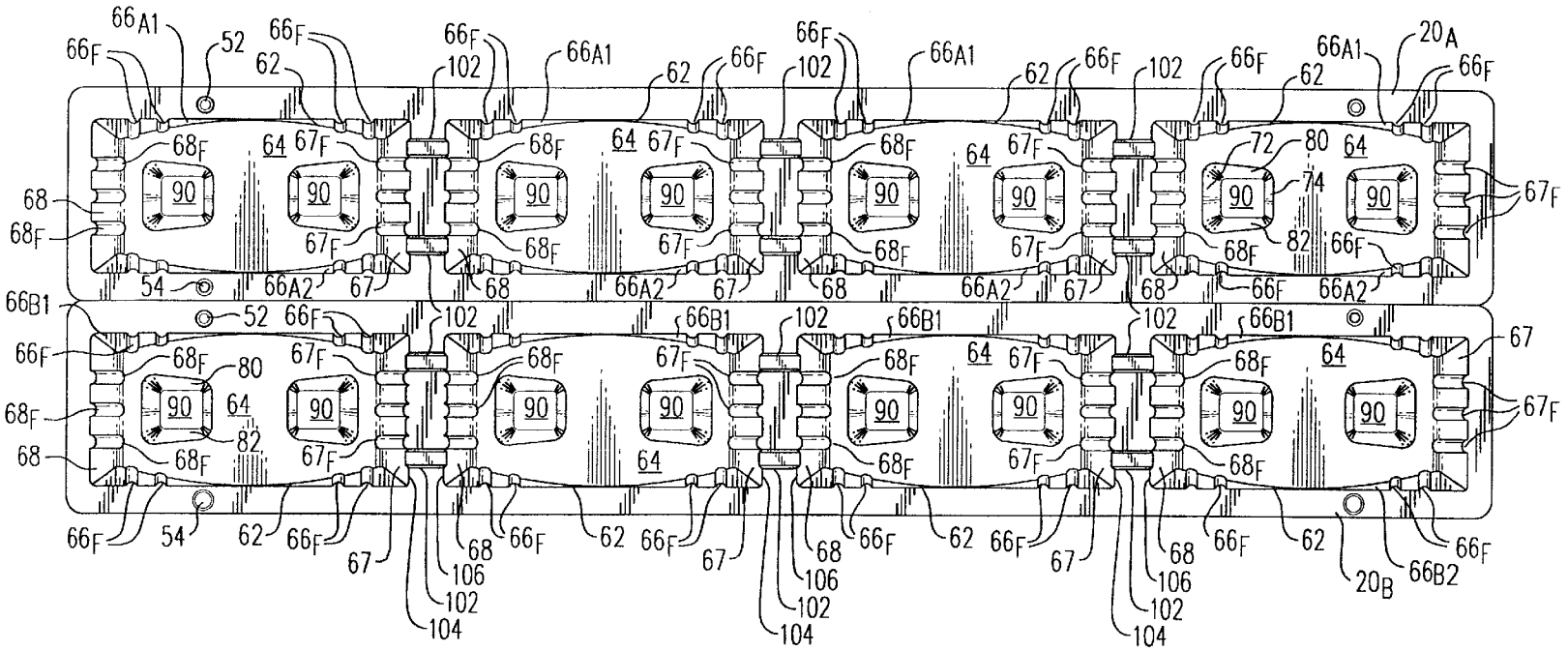
FIG. 12 is a top plan view of a second embodiment of two side-by side roll supports, now provided with the raised strengthening bars between first and second end wall portions, where the strengthening bars are spread apart transversely beyond the structurally enhancing flutes in each of the first and second end wall portions.

As shown in the various figures, between adjacent first 67 and second 68 end wall portions, at least one strengthening ridge 100 is provided. Preferably, two or more outwardly protruding strengthening ridges 100 are provided. In FIGS. 12, 13, and 14, strengthening ridges 102 are illustrated, differing from ridges 100 only in that ridges 102 are spaced apart, transversely, beyond an outer strengthening flute $\mathbf{67}_F$ and $\mathbf{68}_F$ along the bottom 104 of end wall 67, or the bottom 106 of end wall 68. As illustrated, and as appropriate to achieve compact nesting, the strengthening ridges 100 are shown with a trapezoidal cross-sectional shape, when viewed transversely.

The roll stock 22 supported by the illustrated roll supports can be any one of a variety of materials typically wrapped around a spool or core. This rolled material is conventionally placed in the cylindrical or tubular roll for storage, transport and eventual use. The rolled material can be any web material, plastic or film, such as polyethylene or cellophane. As an example, the packaging manufacturing and printing industry employs rolls of plastic film, typically polyethylene, to fabricate bags that receive a printed design or label.

It is also possible to blend the material that forms the roll support 20 of the present invention from other, non-resinous materials, such as fibrous materials, line carbon fiber, or other high strength materials. Also, for certain applications, forming roll supports in the configuration described herein can be advantageously accomplished with wood fiber product compositions. Preferably, any blended or composite materials would be formulated to maintain the thin-walled, thermoformed, advantages as described herein.

The roll support disclosed herein is designed for use both (1) singularly, as to support a first layer of roll stock above a substrate, and (2) in roll support pairs, so that a downward oriented roll support secures a layer of roll stock below, and so that a second, upturned roll support is registered with the downturned one of the pair, for secure mating engagement therewith, so that yet another layer of roll stock can be supported. Thus, pairs of roll supports can be used in a back-to-back fashion and located between tiers or roll stock. Roll supports as taught herein can be manufactured in foldable pairs, or singularly. When manufactured in pairs, they can also be placed in a side-by-side configuration and orientated downwardly facing above a top tier of roll stock, all in order to provide a secure, stacked arrangement of the roll stock that is suited for storage or transport. Alternately, a single roll support can be used where appropriate at the base or at the top of a stack of roll stock.

Importantly, successive singles or pair sets of roll supports in pile of such roll supports will nest tightly within a prior single or lower pair set, thereby substantially reducing the storage space required for both new or for used roll supports.

The roll supports described herein are configured to receive and support horizontally stacked tiers of roll stock. The roll support cradle surface is sized for receiving a preselected diameter of roll stock. The roll support functions to stabilize the tiered array of roll stock, usually located on a shipping pallet. Each roll support is structurally able to support distributed portion of the weight of the roll stock that is received within its roll support cradle portions. Thus, the strong roll stock stacking support design provided is an important improvement in roll supports for roll stock materials.

It is to be appreciated that the various aspects and embodiments of the roll stock stacking supports as described herein are an important improvement in the state of the art of structures and materials for roll stock stacking supports. Although only a few exemplary embodiments have been described in detail, various details are sufficiently set forth in the drawings and in the specification provided herein to enable one of ordinary skill in the art to make and use the invention(s), which need not be further described by additional writing in this detailed description. Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention(s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

What is claimed is:

1. A support apparatus for receiving and supporting two or more pieces of roll stock, said support apparatus comprising:

(a) a plurality of roll support cradle portions, each of said roll support cradle portions comprising (i) an outward surface shaped in an arcuate segment of pre-selected dimensions adapted for securely receiving a piece of roll stock of substantially complementary shape, (ii) a first end wall portion, and (iii) a second end wall portion;

(b) a plurality of pairs of opposing sidewall portions, one of said plurality of pairs provided for each one of said plurality of roll support cradle portions, each of said opposing sidewall portions sloping inwardly and upwardly toward its companion roll support cradle portion;

(c) a first base, said first base providing structural support to (i) each one of said pairs of opposing sidewall portions, which, in turn, each provide structural support for a companion roll support cradle portion, (ii) said first end wall portion, and (iii) said second end wall portion; and (d) one or more support platforms in each of said roll support cradle portions.

2. The support apparatus as set forth in claim 1, wherein each of said one or more support platforms further comprises (a) first and second inwardly and downwardly sloping interior wall portions, each having a lower end portion and (b) a bottom support foot, said bottom support foot located adjacent said lower end portion of said first and said second inwardly and downwardly sloping interior wall portions, and (i) extending laterally across at least a portion of said roll support cradle portion, and (ii) extending downwardly to a location substantially even with said first base.

3. The apparatus as set forth in claim 2, wherein each of said first and second inwardly and downwardly sloping interior wall portions of said support platforms is angled downwardly and inwardly at a preselected angle alpha and beta, respectively.

4. The apparatus as set forth in claim 3 wherein said angle alpha ($\alpha$) is about 20 degrees.

5. The apparatus as set forth in claim 3 wherein said angle beta ($\beta$) is about 20 degrees.

6. The apparatus as set forth in claim 1, wherein each of said opposing sidewall portions is angled upward and inward at an angle sigma ($\Sigma$) of about 20 degrees, with respect to a plane perpendicular to said first base.

7. The apparatus as set forth in claim 1, wherein said support platform comprises a generally concave, stadium bowl shape.

8. The apparatus as set forth in claim 1, wherein each of said roll support cradle portions has a bottom portion, and wherein said bottom portion is elevated above said base.

9. The apparatus as set forth in claim 8, wherein said bottom portion of said roll support cradle portion is elevated about 0.25 inches above said base.

10. The apparatus as set forth in claim 1, wherein said first end wall portion further comprises a plurality of strengthening flutes, said strengthening flutes oriented along the plane of said first end wall portion.

11. The apparatus as set forth in claim 10, wherein said flutes each comprise a long, rounded groove in said first end wall portion.

12. The apparatus as set forth in claim 11, wherein three flutes are provided in said first end wall portion.

13. The support apparatus of claim 12, wherein said plastic material is a recycled plastic, material.

14. The apparatus as set forth in claim 1, wherein at least one of said opposing sidewalls further comprise a plurality of strengthening flutes.

15. The apparatus as set forth in claim 14, wherein both of said opposing sidewalls comprise a plurality of strengthening flutes.

16. The apparatus as set forth in claim 1, further comprising one or more strengthening ridges, said one or more strengthening ridges extending between said first end wall portion and said second end wall portion of adjacent roll support cradle portions.

17. The apparatus as set forth in claim 16, wherein at least two strengthening ridges are provided between said first end wall portion and said second end wall portion of adjacent roll support cradle portions.

18. The apparatus as set forth in claim 17, wherein said strengthening ridges are trapezoidal in cross-sectional shape.

19. The apparatus as set forth in claim 1, further comprising:

(a) a second set of roll support cradle portions, each of said second set of roll support cradle portions comprising (i) an outward surface shaped in an arcuate segment of pre-selected dimensions adapted for securely receiving a piece of roll stock of substantially complementary shape, (ii) a third end wall portion, and (iii) a fourth end wall portion;

(b) a second set of pairs of opposing sidewall portions, one of said plurality of pairs provided for each one of said plurality of roll support cradle portions, each of said opposing sidewall portions sloping inwardly and upwardly toward its companion roll support cradle portion;

(c) a second base, said second base providing structural support to (i) each one of said second set of pairs of opposing sidewall portions, which, in turn, each provide structural support for a companion roll support cradle portion, (ii) said third end wall portion, and (iii) said fourth end wall portion;

(d) one or more support platforms in each of said roll support cradle portions in said second set of roll support cradle portions.

20. The apparatus as set forth in claim 1, wherein said support apparatus comprises a strong, flexible plastic material.

21. The support apparatus as set forth in claim 20, wherein the plastic material comprises polyethylene terephthalate.

22. The support apparatus as set forth in claim 20, wherein said support apparatus comprises a thermoformed solid.

23. The apparatus as set forth in claim 1, wherein said first base portion comprises, along a longitudinal axis, first and second edge portions, and wherein said first and second edge portions each further comprise a plurality of registration locks, said registration locks arranged in complementary interfitting fashion so that a first one and a second one of said support units are interlockingly engaged and thus registered each to the other when first and second support units are placed in back-to-back configuration.

24. The support apparatus as set forth in claim 1, wherein said first base of said support apparatus is sufficiently thin so that at least 16 support apparatus units are stackable in one inch of stacking height.

25. The support apparatus as set forth in claim 1, wherein said first base of said support apparatus is sufficiently thin so that at least 20 support apparatus units are stackable in one inch of stacking height.

26. The support apparatus as set forth in claim 1, wherein said first base of said support apparatus is sufficiently thin so that at least 25 support apparatus units are stackable in one inch of stacking height.

27. The apparatus as set forth in claim 1, wherein said second end wall portion further comprises a plurality of strengthening flutes, said strengthening flutes oriented along the plane of said second end wall portion.

28. The apparatus as set forth in claim 27, wherein said flutes each comprise a long, rounded groove in said second end wall portion.

29. The apparatus as set forth in claim 28, wherein three flutes are provided in said second end wall portion.

30. The combination of (a) a plurality of support apparatus units as set forth in claim 1, and (b) a plurality of rolls of roll stock, wherein (1) a first support layer of two singular support apparatus units, said support apparatus units placed in a substantially parallel, spaced apart relationship with said first base on a selected substrate, said two singular support apparatus units supporting thereon a 1st tier layer in a series of layers from 1 to N layers, said 1st tier layer comprising multiple of rolls of said roll stock, (2) a second support layer of two back-to-back units of said plurality of roll supports stacked on said 1st tier layer of rolls of roll stock, to secure said 1st tier layer and to support a second tier layer of rolls of roll stock. (3) additional support layers of back-to-back configuration roll supports and additional layers of rolls of roll stock thereon, above said second tier layer of roll stock, through an Nth and final layer of rolls of roll stock.

* * * * *